US005690590A

United States Patent [19]

Lo

[11] Patent Number: 5,690,590

[45] Date of Patent: Nov. 25, 1997

[54] MULTI-FUNCTIONAL EXERCISER

[76] Inventor: Chiu-Hsiang Lo, No. 20 Lane 305, Sec. 3, Chung-Shan Road, Tan-Tz Hsiang, Taichung Hsien, Taiwan

[21] Appl. No.: 779,326

[22] Filed: Jan. 6, 1997

[51] Int. Cl.[6] ..... A63B 69/18

[52] U.S. Cl. ..... 482/70; 482/907; 482/51

[58] Field of Search ..... 482/54, 70, 71, 482/51, 907

[56] References Cited

U.S. PATENT DOCUMENTS

| | | | |
|---|---|---|---|
| 5,000,442 | 3/1991 | Dalebout et al. | 482/70 |
| 5,328,427 | 7/1994 | Sleamaker | 482/71 |
| 5,368,533 | 11/1994 | Feuer et al. | 482/70 |
| 5,429,567 | 7/1995 | Gerschefske et al. | 482/70 |
| 5,529,552 | 6/1996 | Biedermann et al. | 482/70 |

*Primary Examiner*—Lynne A. Reichard
*Attorney, Agent, or Firm*—Morton J. Rosenberg; David I. Klein

[57] ABSTRACT

A skiing simulation device includes a pair of horizontal beams and a pair of guiding rails mounted between the horizontal beams. Each guiding rail includes two roller seats having rollers attached thereto so as to slidable along the associated guiding rail. Each of two pedals is mounted to two of the roller seats, the rollers of which are in the same guiding rail to allow skiing simulation practice. Each of the pedals may be mounted to two of the roller seats, the rollers of which are in different guiding rails to allow leg-splay exercises.

10 Claims, 12 Drawing Sheets

MULTI-FUNCTIONAL EXERCISER

BACKGROUND OF THE INVENTION

1. Field of the Invention

The present invention relates to a multi-functional exerciser and, more particularly, to an exerciser which allows other muscle training in addition to practice of skiing simulation in addition to other muscle training.

2. Description of the Related Art

Modern people often lack sufficient exercise, and a wide variety of exercisers have thus been developed to meet this end. Skiing is one of the popular sports for people, and practicing devices therefor have also been developed. Yet such skiing practicing devices often includes a pair of pedals which can only allow longitudinal movements thereof, i.e., lateral movements are not allowed such that the user cannot practice leg-splay exercises and other muscle training.

Therefore, there has been a long and unfulfilled need for an improved multi-functional exerciser which may allow the user to practice skiing as well as other muscle training.

SUMMARY OF THE INVENTION

In accordance with one aspect of the invention, a multi-functional exerciser comprises a pair of horizontal beams and a pair of parallel guiding rails mounted between the horizontal beams. Each guiding rail includes a longitudinal guiding groove defined therein. A pedal means is slidably mounted in each guiding groove. Each pedal means includes a pedal and two roller seats mounted to an underside of the pedal. A plurality of rollers are rotatably mounted to each roller seat and slidable along the associated guiding rail. A plurality of strings are mounted in each guiding groove and roved around a number of support rollers on the roller seats to allow sliding motions of the pedal means along the guiding rails. A vertical beam is mounted on one of the horizontal beams and a pair of handles are respectively pivotally mounted to two opposite sides of the vertical beam.

The pedals and the associated roller seats are disengagable, wherein each pedal includes two recesses defined in the underside thereof, two longitudinal holes each extending along a longitudinal direction of the pedal and in communication with the associated recess, and two lateral holes each extending along a lateral direction of the pedal and in communication with the associated recess. Each roller seat includes a cylinder formed on a top side thereof, the cylinder having a longitudinal bore defined therein. A pin releasably extends through the longitudinal bore of the cylinder and either one of the longitudinal hole and the lateral hole. When each pedal is in a first position, each pedal is mounted to two of the roller seats, the rollers of which are in the same guiding rail and the longitudinal bores of the cylinders of the associated roller seats are in alignment with the associated lateral holes. When each pedal is in a second position, each pedal is mounted to two of the roller seats, the rollers of which are in different guiding rails and the longitudinal bores of the cylinders of the associated roller seats are in alignment with the associated longitudinal holes.

Each pedal includes two notches defined therein and respectively in communication with the longitudinal hole and the lateral hole. The pin further includes a receptacle having a spring received therein. A ball is partially received in the receptacle and biased outwardly so as to partially extend beyond the receptacle into the associated notch.

The exerciser may further comprise a second vertical beam which extends from the other horizontal beam. Each of the first-mentioned vertical beam and the second vertical beam includes a plurality of second strings extending in a hollow interior thereof. Each second string includes a first end which extends beyond an upper end of the associated vertical beam and to which a buckle is securely attached. Each string further includes a second end which is in the interior of the vertical beam and which has a tightness adjusting member securely attached thereto. The tightness adjusting member is adjustable in a height thereof to adjust tightness of the second strings.

In a preferred embodiment of the invention, each vertical beam includes a vertical slot, and the tightness adjusting member includes:

a vertical rod mounted adjacent to the vertical beam;

a sleeve mounted around the vertical rod and having a hole defined in a periphery thereof, a projection projecting from the sleeve into the interior of the vertical beam via the vertical slot, the projection having a screw hole defined therein;

a securing bolt extending through the hole of the sleeve for positioning the sleeve onto the vertical rod by frictional force; and a screw extended through the second end of each second string and then into the screw hole of the projection, thereby securing the second ends of the second strings to the projection to move therewith.

A buckle is securely attached to the first end of each second strip, and a handgrip is releasably attached to the buckle. In an alternative embodiment of the invention, a buckle is securely attached to the first end of each second strip, and a horizontal rod having two spaced loop portions which are releasably engaged to the buckles.

In accordance with another aspect of the invention, a multi-functional exerciser comprises a pair of horizontal beams and a pair of parallel guiding rails mounted between the horizontal beams. Each guiding rail includes a longitudinal guiding groove defined therein. A pedal means is slidably mounted in each guiding groove. Each pedal means includes a pedal and two roller seats mounted to an underside of the pedal. A plurality of rollers are rotatably mounted to each roller seat and slidable along the associated guiding rail. A plurality of strings are mounted in each guiding groove and roved around a number of support rollers on the roller seats to allow sliding motions of the pedal means along the guiding rails. A vertical beam is mounted on one of the horizontal beams and a pair of handles are respectively pivotally mounted to two opposite sides of the vertical beam.

A second vertical beam extends from the other horizontal beam. Each of the first-mentioned vertical beam and the second vertical beam includes a plurality of second strings extending in a hollow interior thereof. Each second string including a first end which extends beyond an upper end of the associated vertical beam and to which a buckle is securely attached. Each string further includes a second end which is in the interior of the vertical beam and which has a tightness adjusting member securely attached thereto. The tightness adjusting member is adjustable in a height thereof to adjust tightness of the second strings.

Other objects, advantages, and novel features of the invention will become more apparent from the following detailed description when taken in conjunction with the accompanying drawings.

DESCRIPTION OF THE PREFERRED EMBODIMENTS

Figure 1:
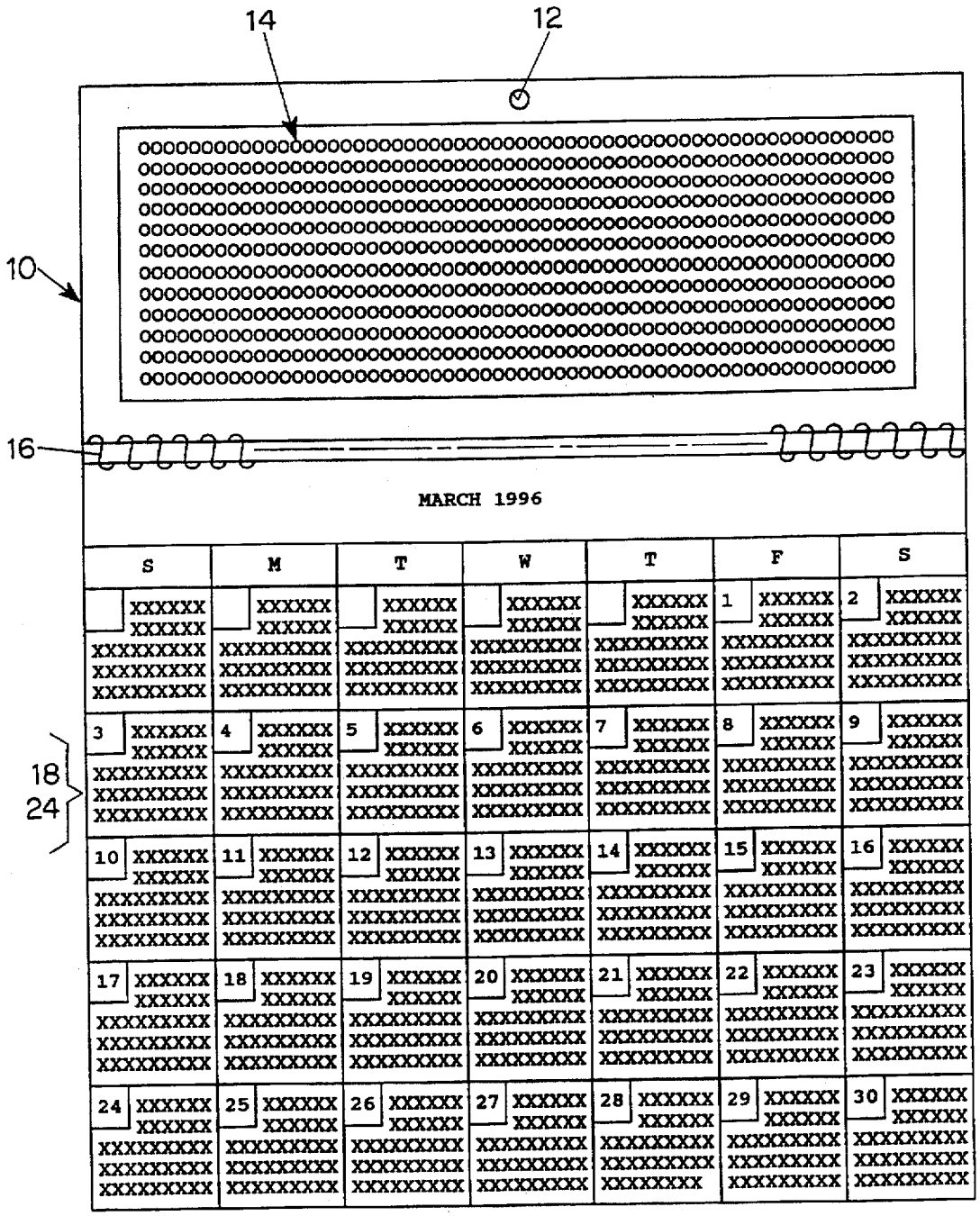
FIG. 1 is a perspective view of a multi-functional exerciser in accordance with the present invention.
Figure 4:
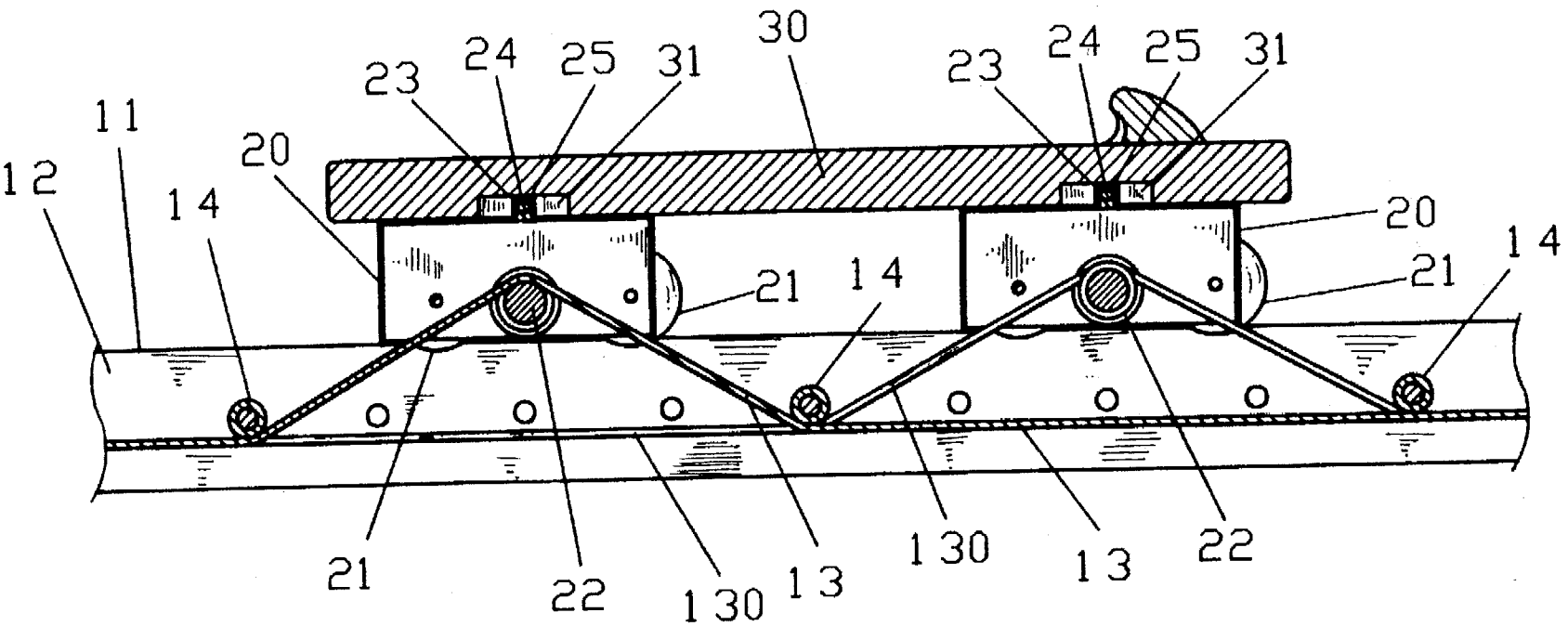
FIG. 4 is cross-sectional view illustrating the pedal means and a part of a guiding rail of the multi-functional exerciser.

Referring to the drawings and initially to FIG. 1, a multi-functional exerciser in accordance with the present invention generally includes a pair of horizontal beams 10 and 100, and a pair of parallel guiding rails 11 mounted between the horizontal beams 10 and 100. Each guiding rail 11 includes a longitudinal guiding groove 12 defined therein. A pedal means is slidably mounted in each guiding groove 12. Further referring to FIG. 2, each pedal means includes a pedal 30 and two roller seats 20 mounted to an underside of the pedal 30. A plurality of rollers 21 are rotatably mounted to each roller seat 20 and slidable along the guiding rail 11. A plurality of pegs 14 are mounted in the guiding rails. 11, while a plurality of strings 13, 130 are mounted in each guiding groove 12 and roved around a number of support rollers 22 on the roller seat 20 and the pegs 14 (see FIG. 4) to allow sliding motions of the pedal means along the guiding grooves 12. A vertical beam 40 is mounted on the horizontal beam 10, and a pair of handles 41 are respectively pivotally mounted to two opposite sides of the vertical beam 40. A user may stand on the pedals 30 and grip the handles 41 to practice skiing simulation. The above-mentioned structure is conventional and therefore not further described.

Figure 2:
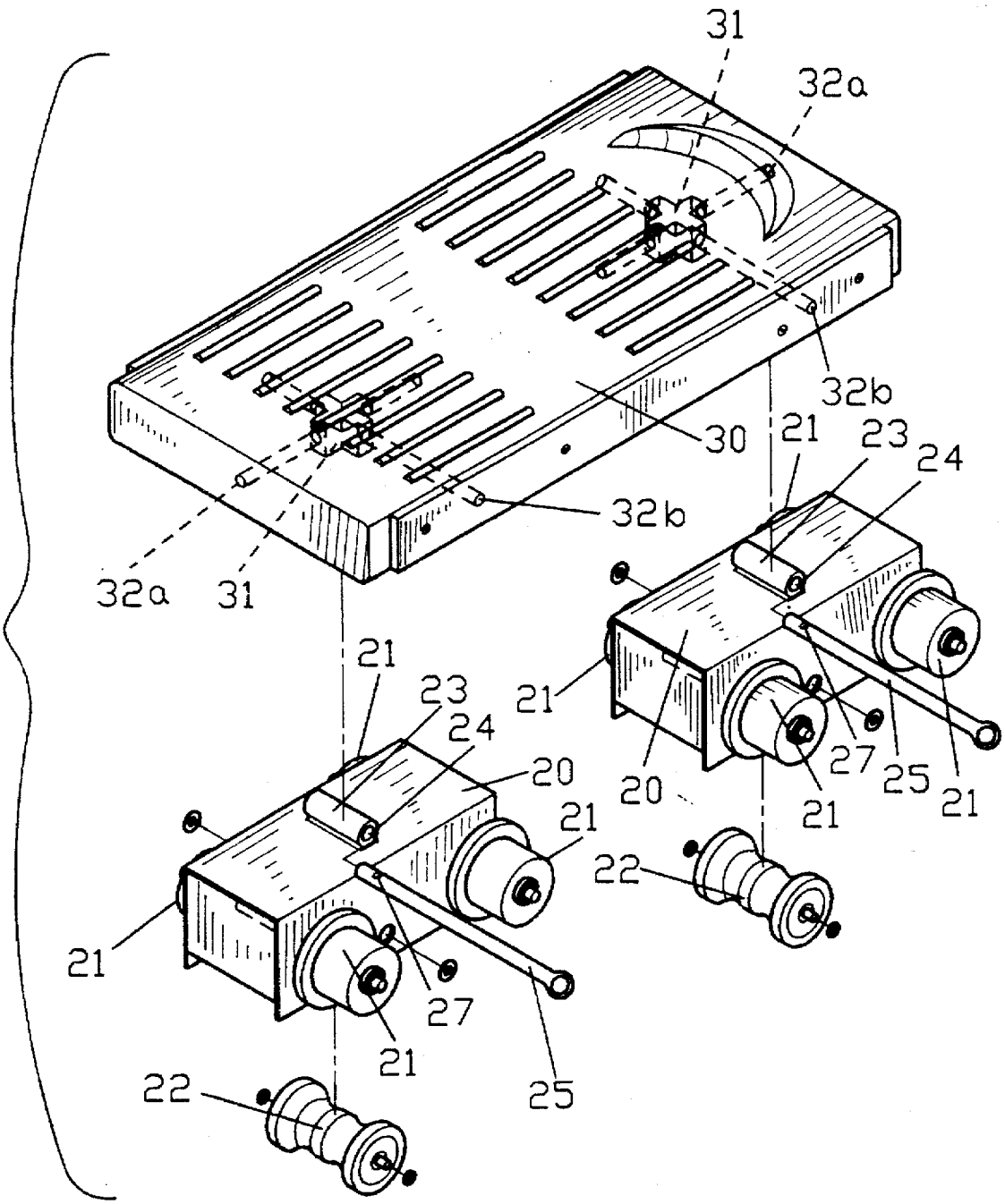
FIG. 2 is an exploded view of a pedal means of the multi-functional exerciser in accordance with the present invention.
Figure 5:
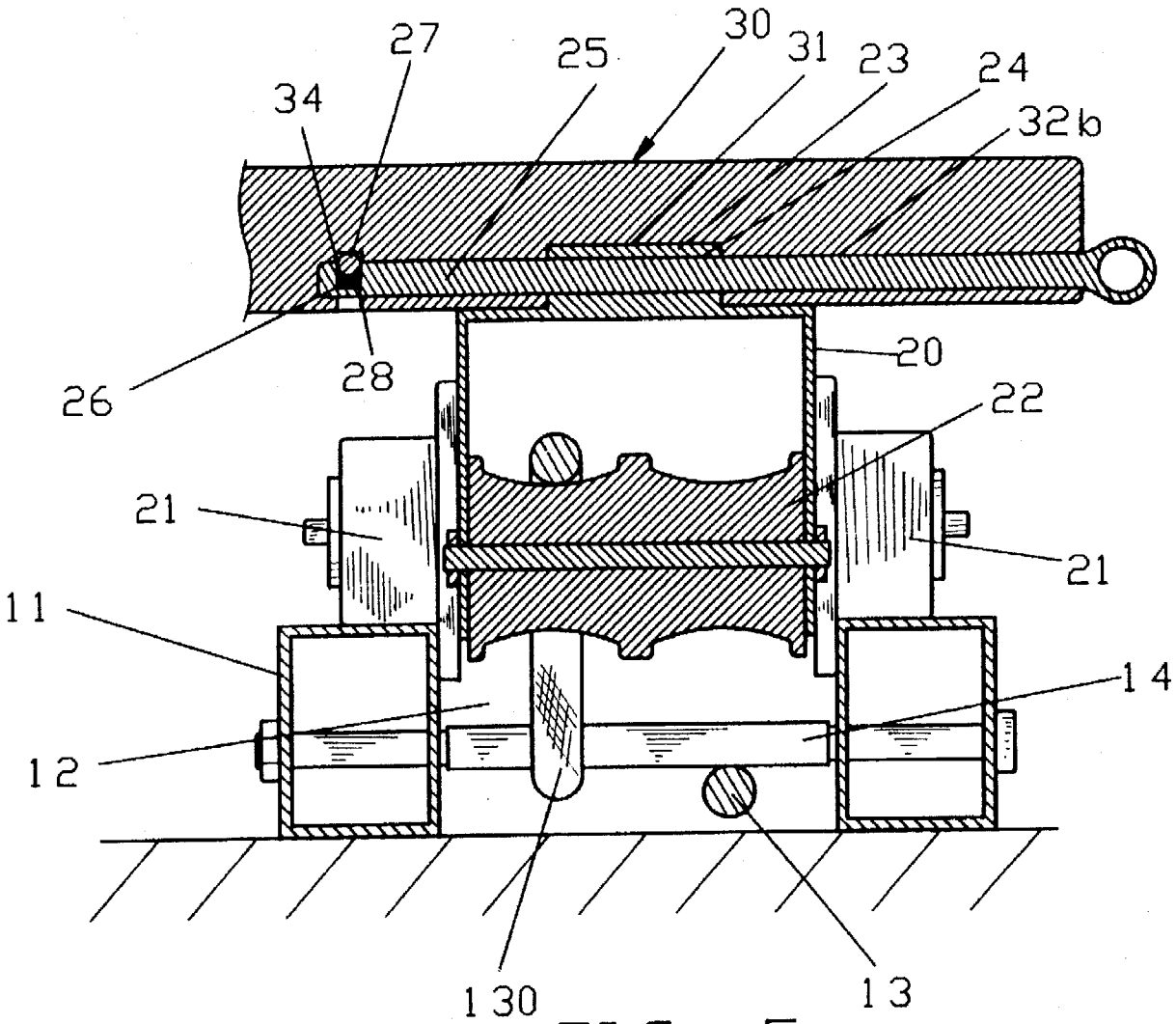
FIG. 5 is a cross-sectional view of the pedal means.

The present invention is characterized by that: the pedal 30 and the roller seat 20 are disengagable. As shown in FIG. 2, the pedal 30 includes two recesses 31 defined in the underside thereof, two longitudinal holes **32*a* each extending along a longitudinal direction of the pedal 30 and in communication with the associated recess 31, and two lateral holes 32*b* each extending along a lateral direction of the pedal 30 and in communication with the associated recess 31. Each roller seat 20 includes a cylinder 23 formed on a top side thereof. The cylinder 23 has a longitudinal bore 24 defined therein, and the cylinder 23 can be secured in the associated recess 31 by a pin 25 extending through either one of the holes 32*a* and 32*b*. As shown in FIG. 5, the roller seat 20 is mounted to an underside of the associated pedal 30, wherein the cylinder 23 is fittingly received in the recess 31 with the bore 24 aligning with, e.g., the lateral hole 32*b*, while the pin 25 is inserted through the bore 24 and the lateral hole 32*b* to secure the roller seat 20 to the pedal 30 so that they move together. Thus, the pedal 30 may slide along the longitudinal direction of the guiding rail 11. In addition, still referring to FIG. 5, the pin 25 may further include a receptacle 28 having a spring 26 received therein, while a ball 27 is partially received in the receptacle 28 and may be biased outwardly so as to partially extend beyond the receptacle 28 into a notch 34 which is defined in the pedal 30 and in communication with the lateral hole 32*b*, thereby providing a reliable positioning effect. It is appreciated that the longitudinal hole 32*a* includes a similar notch (not specifically shown) for positioning of the ball 27 when the pin 25 is inserted into the longitudinal hole 32*a***.

Figure 6:
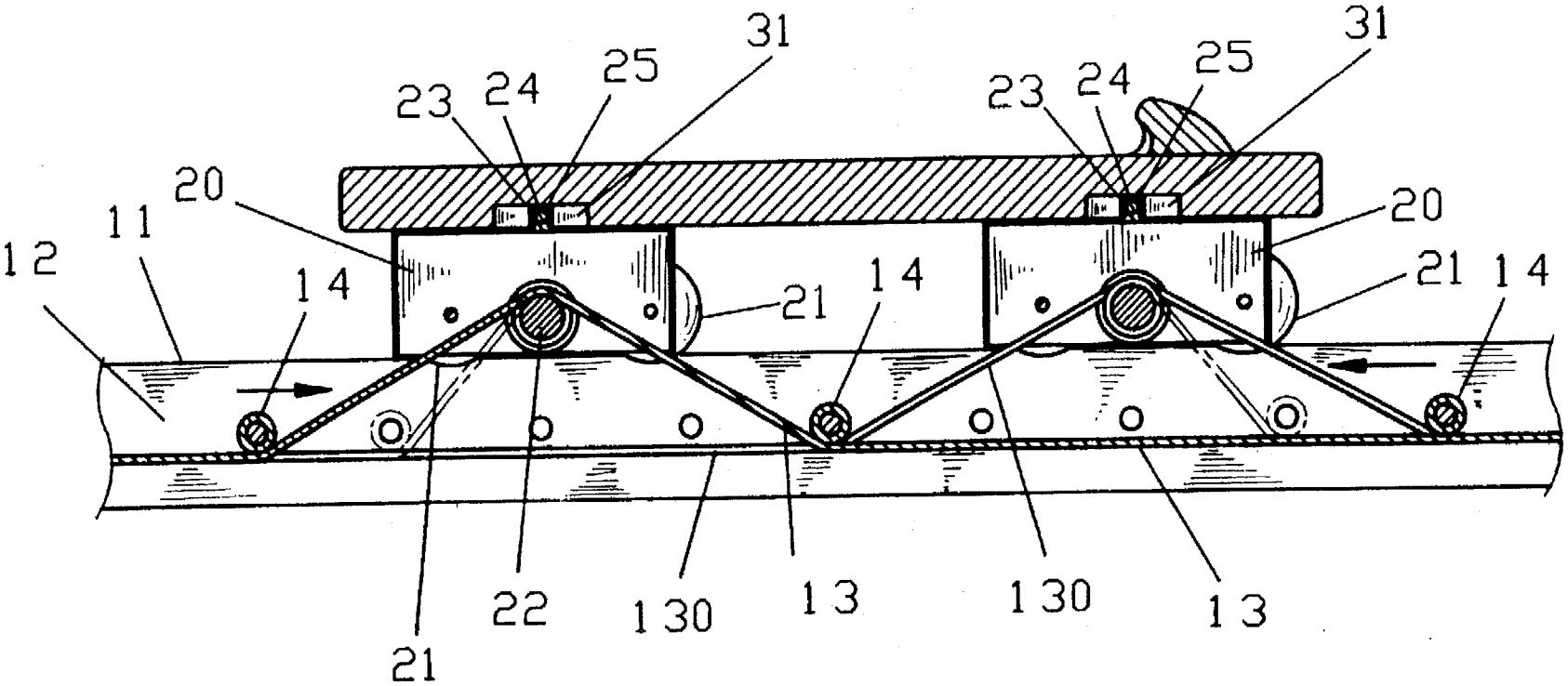
FIG. 6 is a cross-sectional view illustrating adjustment of tightness of strings of the multi-functional exerciser.
Figure 8:
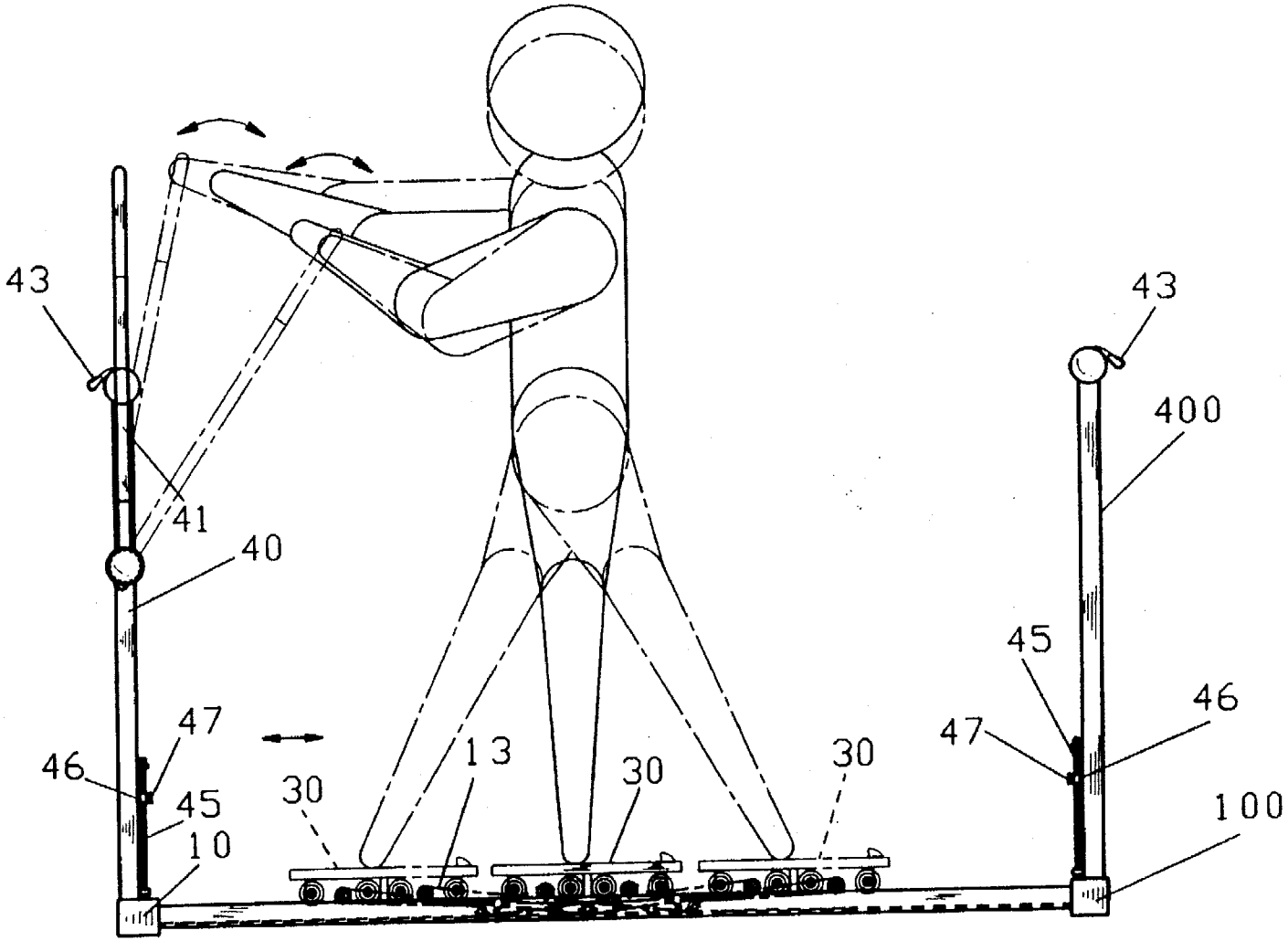
FIG. 8 is a schematic side elevational view illustrating skiing simulation practice of the multi-functional exerciser.

In assembly, each of the pedals 30 is mounted to two aligned roller seats 20, the rollers 21 of which are mounted in the same guiding groove 12 of the associated guiding rail 11 (see FIGS. 1 and 4), in which the engagement thereof is clearly shown in FIGS. 2 and 5. In use, as shown in FIG. 8, the user may stand on the pedals 30 and grip the handles 41 to proceed with normal skiing simulation practice. Referring to FIG. 6, the user may alter the positions of the pegs 14 to adjust the tightness of the strings 13 and 130.

Figure 7:
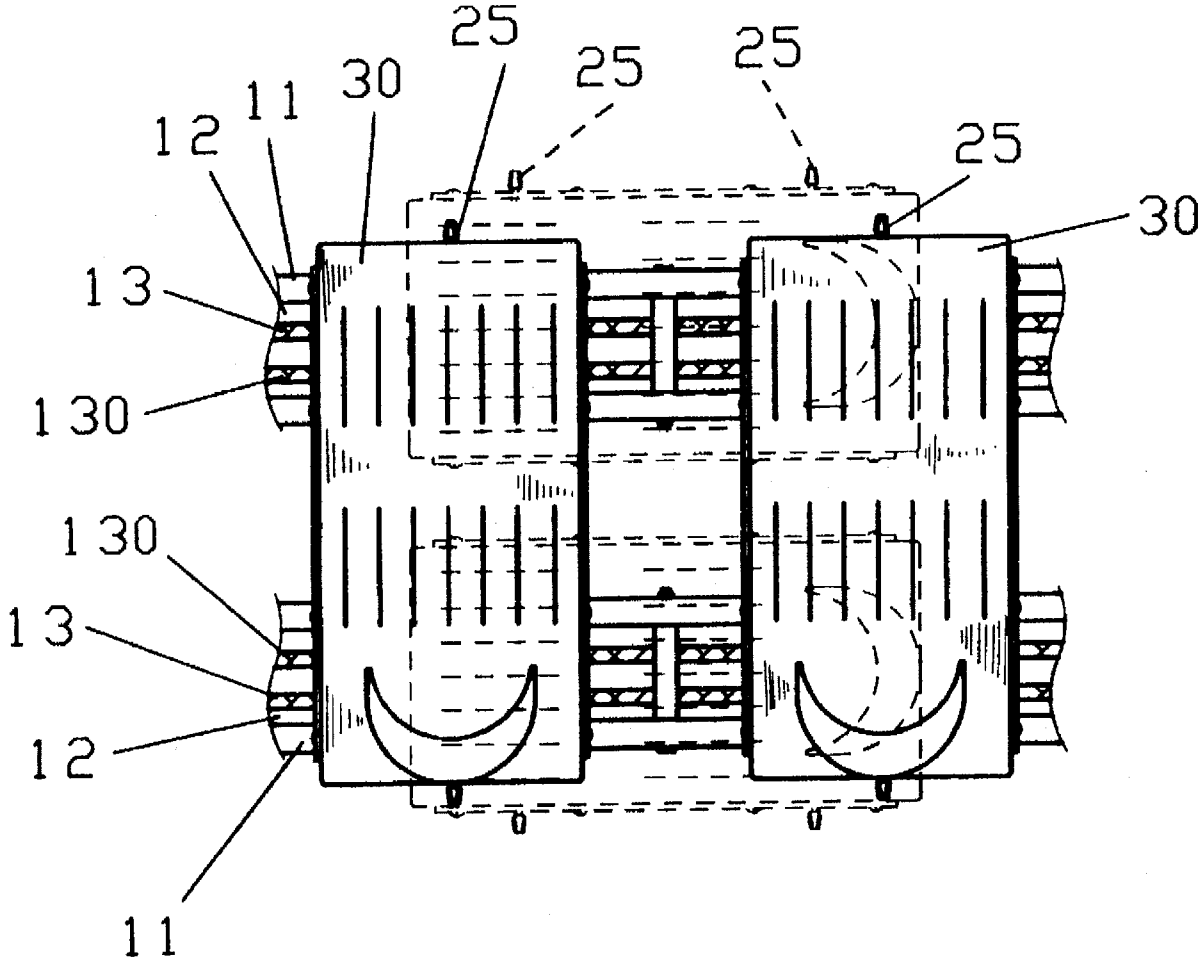
FIG. 7 is a top plan view illustrating conversion of direction of the pedal means.
Figure 9:
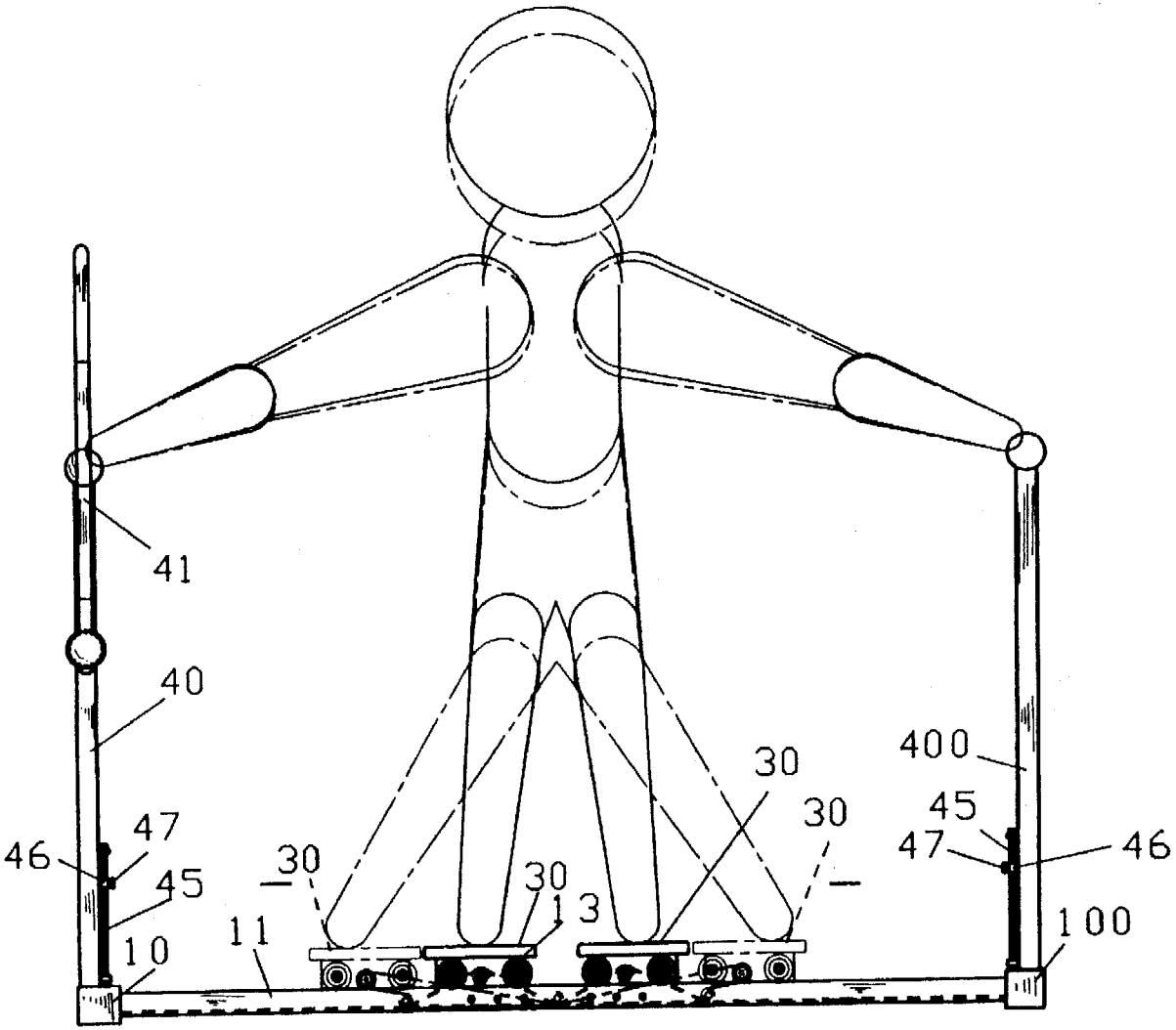
FIG. 9 is a schematic side elevational view illustrating leg-splay exercises of the multi-functional exerciser.

If the user wants to practice leg-splay exercises, he/she may remove the pins 25 (the ball 27 and the spring 26 allows easy removal of the pin 25, see FIG. 5) and disengage the pedals 30 from the roller seats 20 and then mount each of the pedals 30 to two rollers seats 20 which are located on different guiding rails 11 (see FIG. 7), wherein the bores 24 of the roller seats 20 are aligned with the associated longitudinal holes **32*a*. Then, the pins 25 are inserted into the longitudinal holes 32*a*** to complete the assembly (c.f. FIG. 5). Thus, the user may practice leg-splay exercises in a manner shown in FIG. 9.

Figure 3:
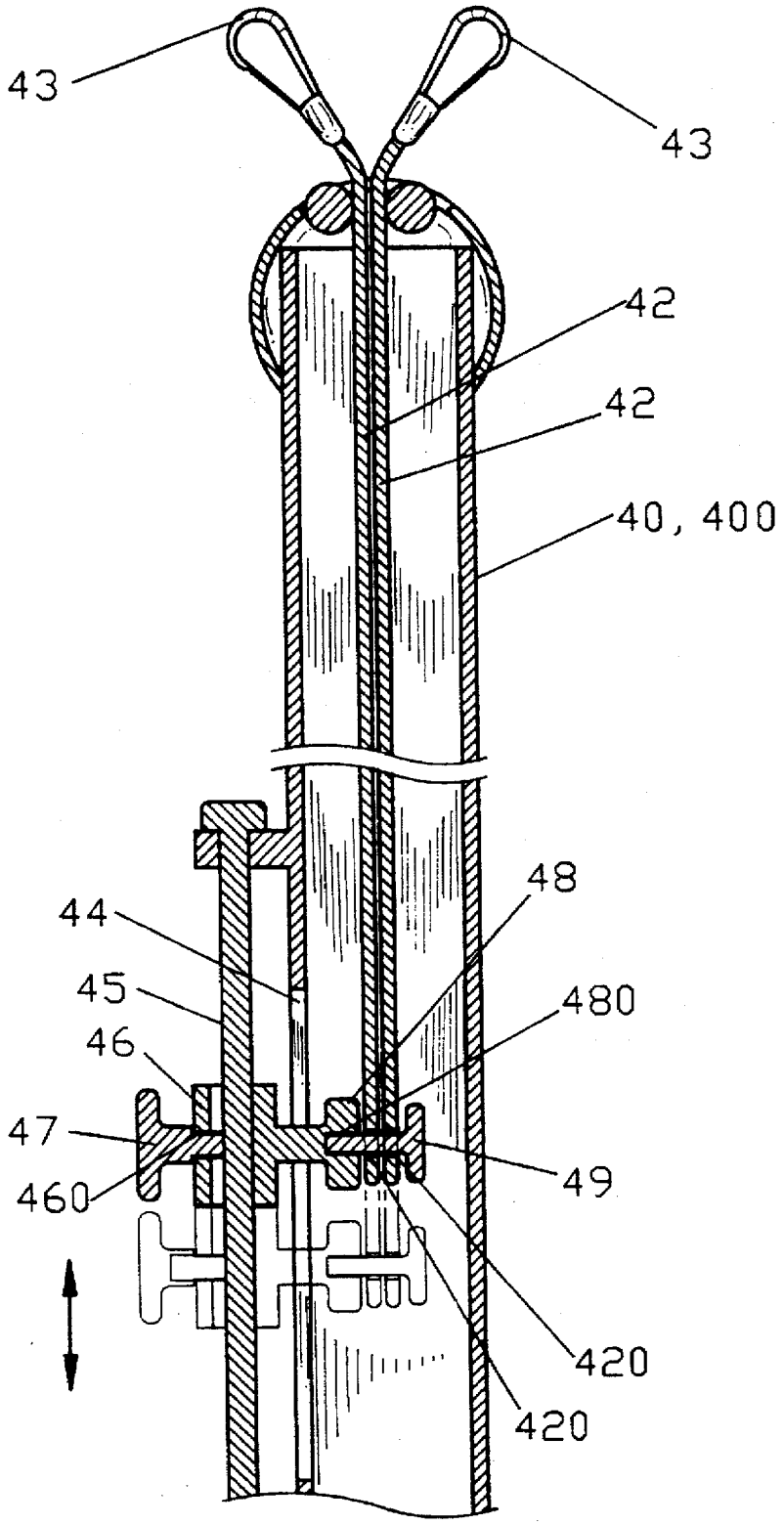
FIG. 3 is a cross-sectional view of a vertical beam of the multi-functional exerciser in accordance with the present invention.

The present invention further includes a second vertical beam 400 which extends from the horizontal beam 100. As shown in FIGS. 1 and 3, each of the first vertical beam 40 and the second vertical beam 400 includes a plurality of strings 42 extending in a hollow interior thereof. Each string 42 includes a first end which extends beyond an upper end of the associated vertical beam 40, 400 and to which a buckle 43 is securely attached. Each string 42 further includes a second end 420 which is in the interior of the vertical beam 40, 400 and which has a tightness adjusting member securely attached thereto. The tightness adjusting member may be adjustable in a height thereof to achieve the required tightness adjustment. In this embodiment, as shown in FIG. 3, a vertical rod 45 is mounted adjacent to the vertical beam 40, 400, and a sleeve 46 is mounted around the vertical rod 45. A securing bolt 47 extends through a hole 460 defined in a periphery of the sleeve 46 for positioning the sleeve 46 onto the vertical rod 40 by frictional force, as shown in FIG. 3. In addition, the vertical beam 40, 400 includes a vertical slot 44, and a projection 48 projecting from the sleeve 46 into the interior of the vertical beam 40, 400 via the vertical slot 44, while a screw 49 is extended through the second end 420 (in the form of a loop) of each string 42 and then into a screw hole 480 defined in the projection 48, thereby securing the loop ends 420 of the strings 42 to the projection 48 to move therewith. The user may adjust the tightness of the strings 42 via adjustment in vertical position of the sleeve 46.

Figure 10:
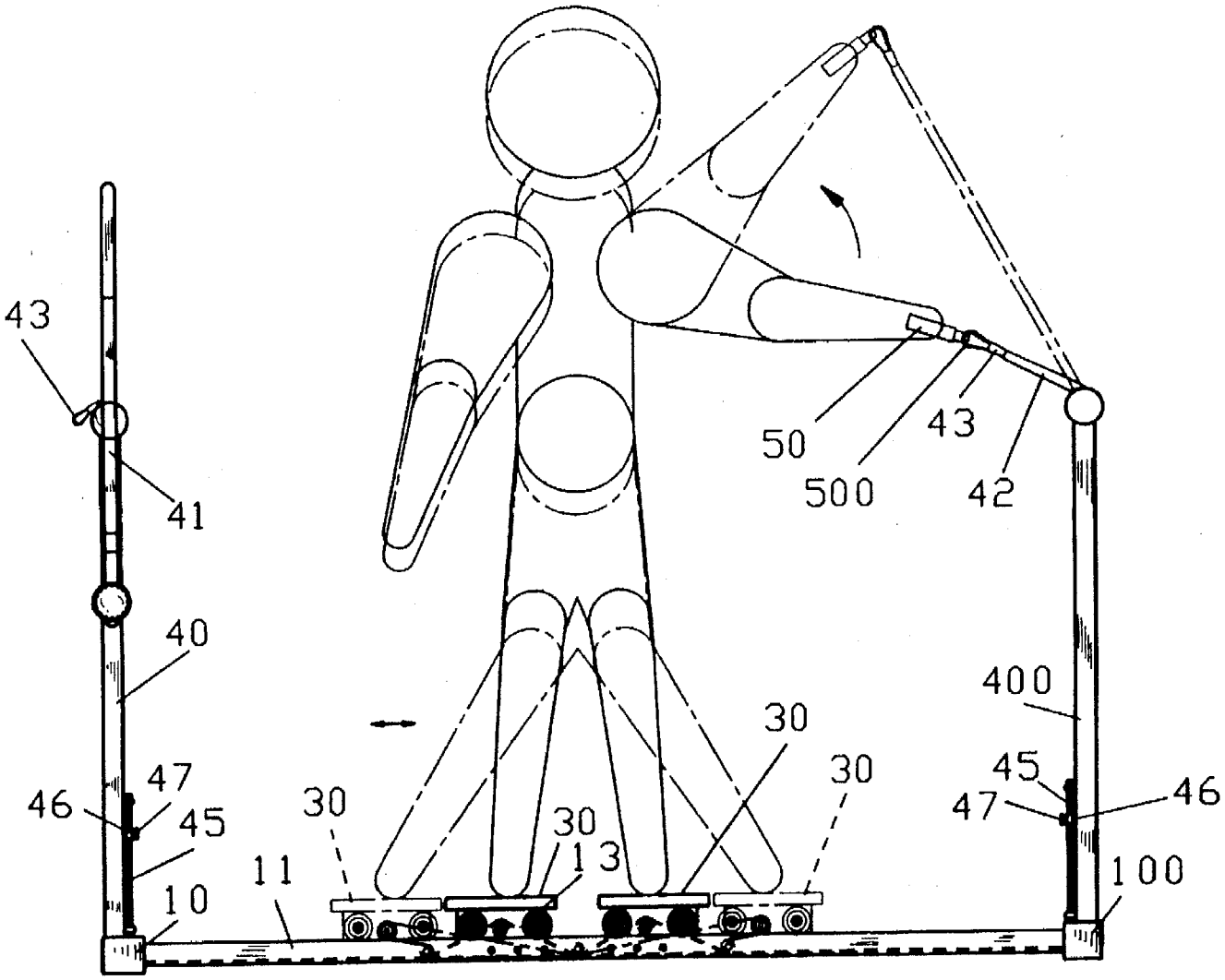
FIG. 10 is a schematic side elevational view illustrating another type of leg-splay exercises of the multi-functional exerciser.
Figure 11:
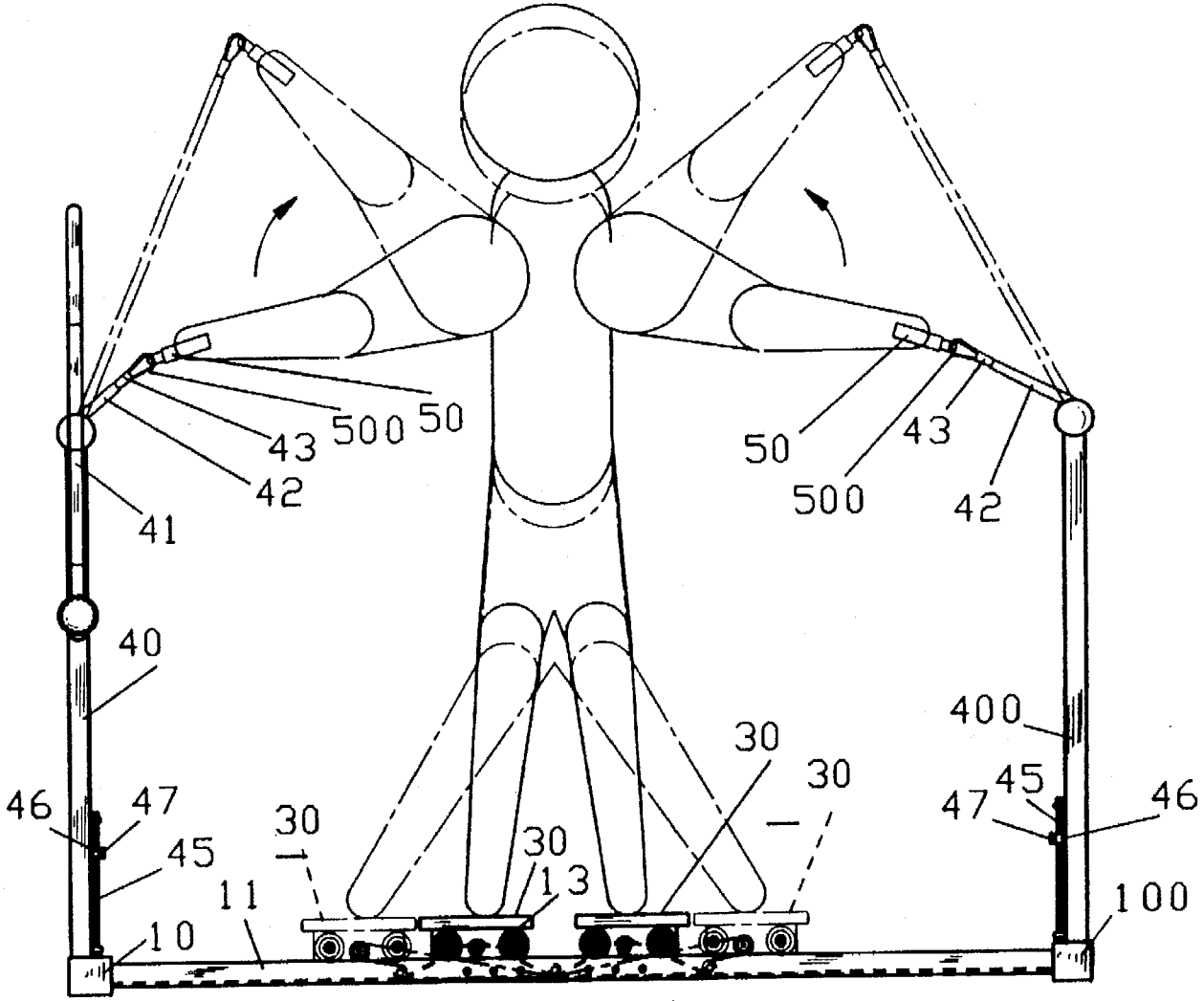
FIG. 11 is a schematic side elevational view illustrating a further type of leg-splay exercises of the multi-functional exerciser.

In use, as shown in FIG. 10, the user may attach a loop portion 500 of a handgrip 50 to one or two buckles 43 (depending on the resistance the user intends to experience) of one of the vertical beams (e.g., the beam 400) to proceed with arm muscle training while practicing leg-splay exercises. Nevertheless, the user may attach a further handgrip 50 to the buckles 43 on the other vertical beam 40 to train muscles of both arms while practicing leg-splay exercises, as shown in FIG. 11.

Figure 12:
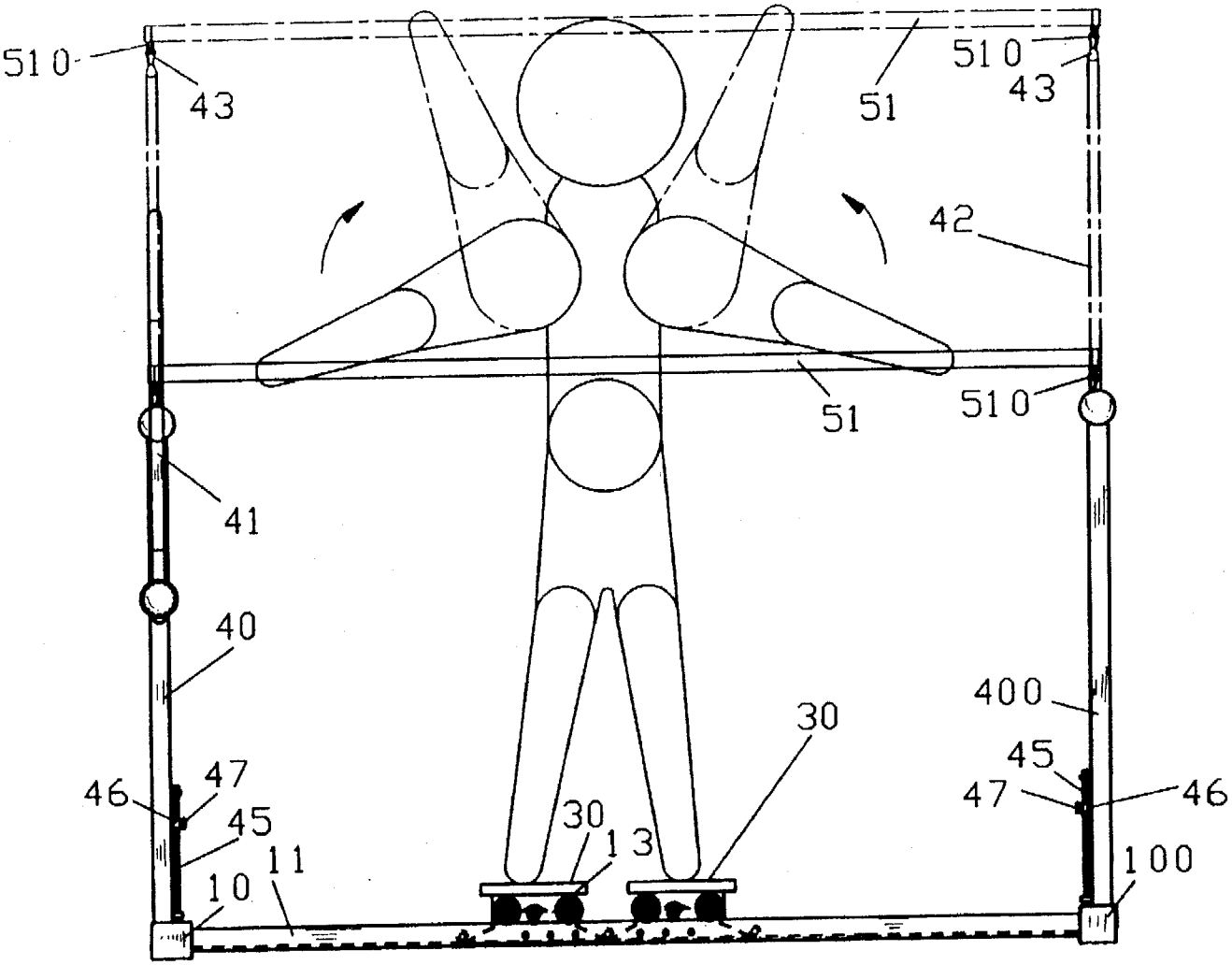
FIG. 12 is a schematic side elevational view illustrating lift practice of the multi-functional exerciser.

Referring to FIG. 12, the user may attach two spaced loop portions 510 of a horizontal rod 51 to the buckles 43 on both vertical beams 40, 400, thereby allowing the user to proceed with lift exercise. It is appreciated that the user may practice leg-splay exercises while practicing lift.

According to the above description, it is appreciated that the multi-functional exerciser in accordance with the present invention may provide skiing practice as well as leg-splay exercises. In addition, the provision of the second vertical beam 400 with strings 42 allows the user to proceed with other muscle training.

Although the invention has been explained in relation to its preferred embodiment, it is to be understood that many other possible modifications and variations can be made without departing from the spirit and scope of the invention as hereinafter claimed.

What is claimed is:

1. An exerciser, comprising a pair of horizontal beams and a pair of parallel guiding rails mounted between the horizontal beams, each guiding rail including a longitudinal guiding groove defined therein, a pedal means being slidably mounted in each said guiding groove, each said pedal means including a pedal and two roller seats mounted to an underside of the pedal, a plurality of rollers being rotatably mounted to each said roller seat and slidable along the associated guiding rail, a plurality of strings being mounted in each said guiding groove and roved around a number of support rollers on the roller seats to allow sliding motions of the pedal means along the guiding rails, a vertical beam being mounted on one of the horizontal beams and a pair of handles being respectively pivotally mounted to two opposite sides of the vertical beam, the improvements comprising:

the pedals and the associated roller seats being disengagable, each said pedal including two recesses defined in the underside thereof, two longitudinal holes each extending along a longitudinal direction of the pedal and in communication with the associated recess, and two lateral holes each extending along a lateral direction of the pedal and in communication with the associated recess, each said roller seat including a cylinder formed on a top side thereof, the cylinder having a longitudinal bore defined therein, and a pin releasably extending through the longitudinal bore of the cylinder and either one of the longitudinal hole and the lateral hole, wherein when each said pedal is in a first position, each said pedal is mounted to two of said roller seats, the rollers of which are in the same guiding rail and the longitudinal bores of the cylinders of the associated roller seats are in alignment with the associated lateral holes, and when each said pedal is in a second position, each said pedal is mounted to two of said roller seats, the rollers of which are in different guiding rails and the longitudinal bores of the cylinders of the associated roller seats are in alignment with the associated longitudinal holes.

2. The exerciser according to claim 1, wherein: each said pedal includes two notches defined therein and respectively in communication with the longitudinal hole and the lateral hole, and the pin further includes a receptacle having a spring received therein, a ball is partially received in the receptacle and biased outwardly so as to partially extend beyond the receptacle into the associated notch.

3. The exerciser according to claim 1, further comprising a second vertical beam which extends from the other of said horizontal beams, each of the first-mentioned vertical beam and the second vertical beam including a plurality of second strings extending in a hollow interior thereof, each said second string includes a first end which extends beyond an upper end of the associated vertical beam and to which a buckle is securely attached, each said string further including a second end which is in the interior of the vertical beam and which has a tightness adjusting member securely attached thereto, the tightness adjusting member is adjustable in a height thereof to adjust tightness of the second strings.

4. The exerciser according to claim 3, wherein each said vertical beam includes a vertical slot, and the tightness adjusting member includes:

a vertical rod mounted adjacent to the vertical beam;

a sleeve mounted around the vertical rod and having a hole defined in a periphery thereof, a projection projecting from the sleeve into the interior of the vertical beam via the vertical slot, the projection having a screw hole defined therein;

a securing bolt extending through the hole of the sleeve for positioning the sleeve onto the vertical rod by frictional force; and a screw extended through the second end of each said second string and then into the screw hole of the projection, thereby securing the second ends of the second strings to the projection to move therewith.

5. The exerciser according to claim 4, further comprising a buckle securely attached to the first end of each said second strip, and a handgrip being releasably attached to said buckle.

6. The exerciser according to claim 4, further comprising a buckle securely attached to the first end of each said second strip, and a horizontal rod having two spaced loop portions which are releasably engaged to the buckles.

7. An exerciser, comprising a pair of horizontal beams and a pair of parallel guiding rails mounted between the horizontal beams, each guiding rail including a longitudinal guiding groove defined therein, a pedal means being slidably mounted in each said guiding groove, each said pedal means including a pedal and two roller seats mounted to an underside of the pedal, a plurality of rollers being rotatably mounted to each said roller seat and slidable along the associated guiding rail, a plurality of strings being mounted in each said guiding groove and roved around a number of support rollers on the roller seats to allow sliding motions of the pedal means along the guiding rails, a vertical beam being mounted on one of the horizontal beams and a pair of handles being respectively pivotally mounted to two opposite sides of the vertical beam, the improvements comprising:

a second vertical beam extending from the other of said horizontal beams, each of the first-mentioned vertical beam and the second vertical beam including a plurality of second strings extending in a hollow interior thereof, each said second string including a first end which extends beyond an upper end of the associated vertical beam and to which a buckle is securely attached, each said string further including a second end which is in the interior of the vertical beam and which has a tightness adjusting member securely attached thereto, the tightness adjusting member being adjustable in a height thereof to adjust tightness of the second strings.

8. The exerciser according to claim 7, wherein each said vertical beam includes a vertical slot, and the tightness adjusting member includes:

a vertical rod mounted adjacent to the vertical beam;

a sleeve mounted around the vertical rod and having a hole defined in a periphery thereof, a projection projecting from the sleeve into the interior of the vertical beam via the vertical slot, the projection having a screw hole defined therein;

a securing bolt extending through the hole of the sleeve for positioning the sleeve onto the vertical rod by frictional force; and a screw extended through the second end of each said second string and then into the screw hole of the projection, thereby securing the second ends of the second strings to the projection to move therewith.

9. The exerciser according to claim 8, further comprising a buckle securely attached to the first end of each said second strip, and a handgrip being releasably attached to said buckle.

10. The exerciser according to claim 8, further comprising a buckle securely attached to the first end of each said second strip, and a horizontal rod having two spaced loop portions which are releasably engaged to the buckles.

* * * * *